US006626645B2

(12) United States Patent
Okii et al.

(10) Patent No.: US 6,626,645 B2
(45) Date of Patent: Sep. 30, 2003

(54) CONTROL VALVE FOR VARIABLE CAPACITY COMPRESSORS

(75) Inventors: Toshiki Okii, Tokyo (JP); Yoshiyuki Kume, Tokyo (JP); Masayuki Imai, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/109,661

(22) Filed: Apr. 1, 2002

(65) Prior Publication Data

US 2002/0182087 A1 Dec. 5, 2002

(30) Foreign Application Priority Data

Apr. 6, 2001 (JP) ..... 2001-108951

(51) Int. Cl.[7] ..... F04B 1/26; F16K 31/02

(52) U.S. Cl. ..... 417/222.2; 251/129.02; 251/129.15

(58) Field of Search ..... 417/222.2, 222.1; 251/129.02, 129.15

(56) References Cited

U.S. PATENT DOCUMENTS 5,890,876 A * 4/1999 Suito et al. ..... 417/213
6,062,824 A * 5/2000 Kimura et al. ..... 417/222.2
6,146,106 A * 11/2000 Suitou et al. ..... 417/222.2
6,217,290 B1 * 4/2001 Imai et al. ..... 417/222.1
6,439,858 B1 * 8/2002 Kume et al. ..... 417/222.2

FOREIGN PATENT DOCUMENTS

| | | |
|---|---|---|
| JP | 03-023385 | 1/1991 |
| JP | 09-268973 | 10/1997 |
| JP | 09-268974 | 10/1997 |
| JP | 11-218078 | 8/1999 |
| JP | 2000-193122 | * 7/2000 |

* cited by examiner

*Primary Examiner*—Charles G. Freay
*Assistant Examiner*—Michael K. Gray
(74) *Attorney, Agent, or Firm*—Rader, Fishman & Grauer PLLC

(57) ABSTRACT

A valve element disposed in the valve chamber of a control valve body of a control valve for variable capacity compressors performs opening and closing operations by a plunger. The upper end of the valve element of this control valve body is inserted in the pressure chamber, while the lower end of the valve element is inserted in the plunger chamber of the solenoid excitation part. And the plunger chamber and the pressure chamber communicate with each other through a cancel hole formed in this valve element.

7 Claims, 11 Drawing Sheets

CONTROL VALVE FOR VARIABLE CAPACITY COMPRESSORS

BACKGROUND OF THE INVENTION

1. Field of the Invention

The present invention relates to a control valve for variable capacity compressors used in air conditioners of vehicles and the like and, more particularly, to a control valve for variable capacity compressors that controls the supply of a coolant gas in the interior of a crankcase from a discharge-pressure region as required.

2. Description of the Prior Art

Conventionally, variable capacity compressors provided with a cylinder, a piston, a wobble plate, etc. have been used, for example, in compressing and delivering a coolant gas of an air conditioner for automobiles. A known variable capacity compressor of this type is provided with a coolant-gas passage that communicates with a discharge-pressure region and a crankcase, and changes the inclination angle of the wobble plate by adjusting the pressure in the interior of the crankcase thereby to change discharge capacity. The pressure adjustment in the interior of the crankshaft is performed by supplying a high-pressure compressed coolant gas from the discharge-pressure region to the crankcase by the opening adjustment of a control valve provided within the coolant-gas passage.

For example, a control valve 100' as shown in FIGS. 10 and 11 is known (Japanese Patent Application Laid-Open Nos. 9-268973 and 9-268974) as a control valve for such a variable capacity compressor as described above. This control valve 100' is provided on the side of the rear housing 210 of a variable capacity compressor 200, and performs the pressure adjustment of a crankcase 231 within a front housing 230, which is installed in connection with a cylinder block 220 of the variable capacity compressor 200.

In the interior of the crankcase 231, a wobble plate 240 is supported by a driving shaft 250 in a manner such that the wobble plate 240 can slide in the axial direction of the driving shaft 250 and tilt. A guide pin 241 of this wobble plate 240 is slidably supported by a support arm 252 of a rotary support 251. Also, the wobble plate 240 is connected, via a pair of shoes 242, to a piston 260, which is slidably disposed within a cylinder bore 221.

The wobble plate 240 rotates in the directions indicated by an arrow shown in FIG. 10 according to a difference between the suction pressure Ps in the cylinder bore 221 and the crankcase pressure Pc in the crankcase 231, and changes the inclination angle of the wobble plate 240 itself. On the basis of the inclination angle of the wobble plate 240, the stroke width of forward and backward movements of the piston 260 in the cylinder bore 221 is determined. And a blocking element 270 that abuts against the middle portion of the wobble plate 240 moves forward and backward in a housing hole 222 as the wobble plate 240 rotates in the directions indicated by the arrow.

In the interior of the rear housing 210, suction chambers 211*a*, 211*b*, which constitute a suction-pressure region, and discharge chambers 212*a*, 212*b*, which constitute a discharge-pressure region, are defined and formed. When the piston 260 moves forward and backward on the basis of the rotation of the wobble plate 240, a coolant gas in the suction chamber 211*a* is sucked into the interior of the cylinder bore 221 from a suction port 213, is compressed to a prescribed pressure and is then delivered from a discharge port into the discharge chamber 212*a*.

Furthermore, a suction passage 215 formed in the center portion of the rear housing 210 communicates with the housing hole 222 and, at the same time, the suction passage 215 communicates also with the suction chamber 211*b* via a through hole 216. When the wobble plate 240 moves to the side of the blocking element 270, the blocking element 270 moves to the side of the suction passage 215 and blocks the through hole 216.

The upper side of the control valve 100' communicates with the suction passage 215 via a pressure-detection passage 217 that introduces the suction pressure Ps into the interior of the control valve 100'. Furthermore, the discharge chamber 212*b* and the crankcase 231 communicate with each other via air supply passages 218, 219 of the control valve 100'. The air supply passages 218, 219 are opened and closed by a valve element 106' of the control valve 100'.

The discharge pressure Pd of the discharge chamber 212*b* is introduced into a valve chamber port 113' via the air supply passage 218. The pressure Pc within the crankcase is introduced into the air supply passage 219 via a valve hole port 114'. The suction pressure Ps is introduced into a suction pressure introduction port 115' via the pressure-detection passage 217.

When an operation switch 280 of an air conditioner is on, for example, when a temperature detected by a room sensor 281 is not less than a temperature set by a room temperature setting device 282, a control computer 283 gives instructions to a solenoid 101' of the control valve 100' and causes the solenoid 101' to supply a prescribed current to a driving circuit 284. And a moving core 102' is attracted toward the fixed core 104' by the attraction of the solenoid 101' and the urging force of a spring 103'.

With the movement of the moving core 102' the valve element 106' attached to a solenoid rod 105' moves, while resisting the urging force of a forced relief spring 107', in a direction in which the opening of a valve hole 108' is reduced. With the movement of this valve element 106' a pressure-sensitive rod 109', which is integral with the valve element 106', also rises. As a result of this, a bellows 111' is pressed, which is connected to the valve element 106' via a pressure-sensitive rod receiving part 110' in such a manner that the bellows 111' can come close to and away from the valve element 106'.

The bellows 111' is displaced according to variations in the suction pressure Ps introduced into the interior of a pressure-sensitive part 112' via the pressure-detection passage 217, and gives loads to the pressure-sensitive rod 109'. Accordingly, the opening of the valve hole 108' of control valve 100' by the valve element 106' is determined by a combination of the attraction by the solenoid 101', the urging force of the bellows 111' and the urging force of the forced relief spring 107'.

When a difference between a temperature detected by the room sensor 281 and a temperature set by the room temperature setting device is great (when the cooling load is large), an increase in supply current causes the fixed core 104' to attract the moving core 102', and the opening of the valve hole 108' by the valve element 106' decreases. As a result, the control valve 100' operates in such a manner that the control valve 100' holds a lower suction pressure Ps, and under this suction pressure Ps the opening and closing of the valve element 106' is performed.

When the valve opening decreases, the volume of the coolant gas that flows from the discharge chamber 212*b* via the air supply passages 218, 219 into the crankcase 231 decreases and, at the same time, the gas in the crankcase 231 flows out and enters the suction chambers 211*b*, 211*a*, with the result that the pressure Pc in the crankcase drops. And when the cooling load is large, the suction pressure Ps in the cylinder bore 221 increases and a difference is made between the suction pressure Ps and the pressure Pc in the crankcase, resulting in an increased inclination angle of the wobble plate 240. As a result, the blocking element 270 leaves the side of the suction passage 215 and opens the through hole 216.

Incidentally, as shown in FIGS. 10 and 11, the above-described conventional control valve 100' is constructed in such a manner that the discharge pressure Pd is introduced into the valve chamber port 113' of the control valve 100' via the air supply passage 218. This discharge pressure Pd is high and besides the coolant gas that generates the discharge pressure Pd gives off high heat by being compressed by the forward and backward motions of the piston 260 until a prescribed pressure is reached, with the result that the control valve 100' itself is heated by this high heat and the accuracy of opening and closing of the valve hole 108' by the valve element 106' decreases, posing a problem.

Also, because the distance between the point of application of the attraction of solenoid rod 105' by the solenoid 101' and the point of application of the urging force by the bellows 111' is large, there is a fear that during the movement of the solenoid rod 105' at the time of valve closing, backlash might occur in the solenoid rod 105', thereby hindering an improvement in the accuracy of valve opening and closing.

In order to solve this problem, there is disclosed in Japanese Patent Application Laid-Open No. 11-218078 a technique for bringing the point of application of the attraction of solenoid rod close to the point of application of the urging force of bellows by disposing a bellows below a solenoid rod. With this technique, however, a low suction pressure Ps becomes apt to remain as a coolant pool on the bellows side and, therefore, no special consideration is given to factors responsible for the hindrance to plunger motions, such as sticking by plane contact between the lower end of the control valve proper and the upper end surface of the plunger, or factors responsible for the hindrance to the motions of the plunger and stem by the damper action of a coolant.

Furthermore, the pressure-receiving area that receives the crankcase pressure Pc on the upper side of the moving direction of the valve element 106' is adjusted to such a size that the respective pressure-receiving areas of valve hole 108' and solenoid rod 105' are not affected by pressure. However, because the suction pressure Ps and crankcase pressure Pc are not always held at the same level of pressure, the suction pressure Ps and crankcase pressure Pc are not completely balanced out. In addition, because the pressure in the crankcase shows great pressure variations due to the operation of a compressor, forces acting on the valve element 106' also vary when the pressure variations occur, posing a problem of an adverse effect on the opening and closing accuracy of the valve element 106'.

Also, in the conventional control valve for variable capacity compressors, a pressure-sensitive bellows and means for exciting a solenoid are arranged side by side in the opening and closing direction of a valve element and, therefore, this poses a problem of difficulty in achieving compact design suitable for a part to be installed in a car.

OBJECTS AND SUMMARY OF THE INVENTION

An object of the present invention is to provide a control valve for variable capacity compressors which improves the accuracy of valve opening and closing by eliminating an adverse effect of a coolant gas pressure acting on the valve element of the control valve, and which, at the same time, permits compact design.

In order to achieve the above-described object, in a first aspect of the present invention there is provided a control valve for variable capacity compressors, which comprises a control valve body, a solenoid excitation part and a pressure-sensitive part. The solenoid excitation part is provided with a solenoid and a plunger moving vertically by the excitation of the solenoid. The control valve body is disposed on the upper side of the solenoid excitation part and has a valve chamber provided with a valve hole on the bottom surface thereof, a pressure chamber disposed above the valve chamber, and a valve element disposed in the valve chamber and performing opening and closing operations by the plunger. The upper end of the valve element of the control valve body is inserted in the pressure chamber and the lower end thereof is inserted in the plunger chamber of the solenoid excitation part. And, the plunger chamber and the pressure chamber communicate with each other through a cancel hole formed in the valve element.

Because in the control valve for variable capacity compressors of the present invention constructed as described above, the coolant gas at the suction pressure Ps in the plunger chamber is introduced into the pressure chamber via the cancel hole, the valve element is subjected to the suction pressure Ps from both sides of the upper and lower portions thereof. In addition, because the upper and lower portions of the valve element have the same sectional area, the valve element is not influenced by the discharge pressure Pd. Therefore, because pressure balance is always maintained in the upper and lower portions of the valve element, the valve opening and closing accuracy can be improved. In addition, because the cancel hole is provided in the valve element, the working of the cancel hole can be easily performed.

Furthermore, in a second aspect of the present invention there is provided a control valve for variable capacity compressors, which comprises a control valve body, a solenoid excitation part and a pressure-sensitive part. The solenoid excitation part is provided with a solenoid, a plunger moving vertically by the excitation of the solenoid and an attraction element on the lower side of the plunger. And the pressure-sensitive part is formed on the inner side of the attraction element. As a result, because the pressure-sensitive part is formed on the inner side of the attraction element, it is possible to ensure compact design of the control valve by reducing the diameter of the solenoid excitation part.

In the control valve for variable capacity compressors according to the present invention, the following preferred embodiments can be adopted.

The attraction element is in the form of a cylinder with a bottom opposed to the plunger. Alternatively, the attraction element comprises a cylindrical portion to be engaged with the inner side of the solenoid excitation part and a cover portion to be press-fitted to the upper end of this cylindrical portion.

The plunger is provided with a coolant vent in the interior thereof in the longitudinal axial direction. Alternatively, the plunger is provided with a slit on the side surface thereof in the longitudinal axial direction.

The solenoid excitation part is provided with a stem having an almost half-moon section for transmitting the motion of the above-described pressure-sensitive part to the plunger.

BRIEF DESCRIPTION OF THE DRAWINGS

The above-mentioned and other objects and features of the present invention will become apparent from the following description of the embodiments taken in connection with the accompanying drawings in which.

DETAILED DESCRIPTION OF THE PREFERRED EMBODIMENTS

Figure 1:
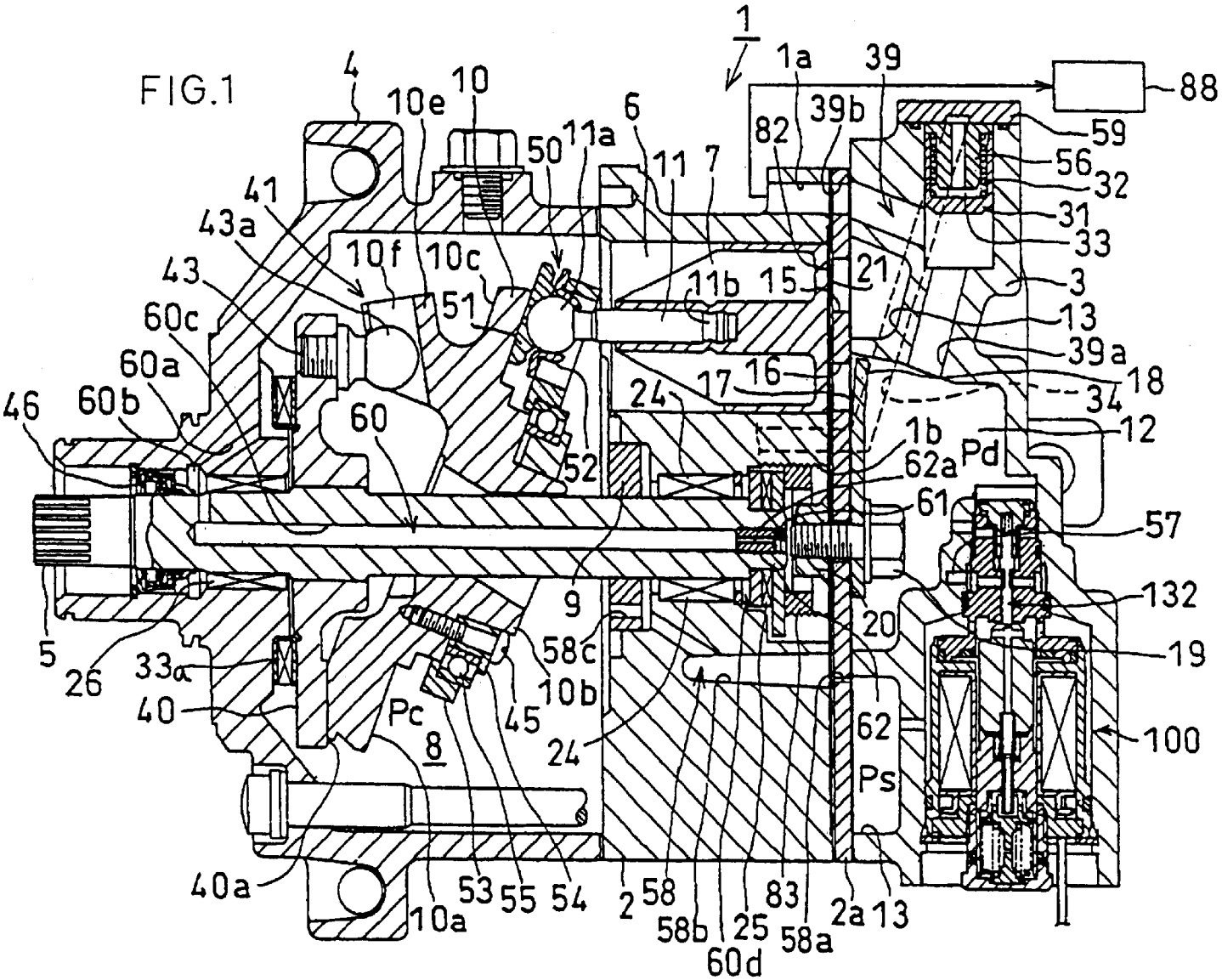
FIG. 1 is a longitudinal sectional view of a variable capacity compressor provided with a control valve of the first embodiment of the present invention, wherein the discharge passage of the compressor is in open state.

First, a variable capacity compressor provided with a control valve 100 in the first embodiment of the present invention will be described below by referring to FIGS. 1 and 2.

A rear housing 3 is fixed to one end surface of a cylinder block 2 of a variable capacity compressor 1 via a valve plate 2*a*, and a front housing 4 is fixed to the other end surface thereof. In the cylinder block 2, a plurality of cylinder bores 6 are disposed around a shaft 5 at equal intervals in a circumferential direction. A piston 7 is slidably housed in each cylinder bore 6.

A crankcase 8 is formed in the front housing 4. A wobble plate 10 is disposed in the crankcase 8. On a sliding surface 10*a* of the wobble plate 10, a shoe 50, that supports one spherical end 11*a* of a connecting rod 11 such that the spherical end 11*a* can slide relative to the shoe 50, is held by a retainer 53. The retainer 53 is mounted to a boss 10*b* of the wobble plate 10 via a radial bearing 55 such that the retainer 53 can rotate relative to the wobble plate 10. The radial bearing 55 is locked to the boss 10*b* by means of a stopper 54 fixed by a screw 45. The other end 11*b* of the connecting rod 11 is fixed to the piston 7.

The shoe 50 is composed of a shoe body 51 which supports the leading end surface of one end 11*a* of the connecting rod 11 such that the one end 11*a* can roll relative to the shoe 50, and a washer 52 which supports the trailing end surface 11*a* of the connecting rod 11 such that the trailing end surface 11*a* can roll relative to the washer 52.

A discharge chamber 12 and a suction chamber 13 are formed in the rear housing 3. The suction chamber 13 is arranged so as to surround the discharge chamber 12. A suction port (not shown) that communicates with an evaporator (not shown) is provided in the rear housing 3. FIG. 1 shows a discharge passage 39 in an open state and FIG. 2 shows the discharge passage 39 in a closed state. Midway in the discharge passage 39 that provides communication between the discharge chamber 12 and a discharge port 1*a*, there is provided a spool valve (a discharge control valve) 31. The discharge passage 39 is composed of a passage 39*a* formed in the rear housing and a passage 39*b* formed in the valve plate 2*a*. The passage 39*b* communicates with the discharge port 1*a* formed in the cylinder block 2.

A spring (an urging member) 32 is disposed within the cylindrical spool valve 31 having a bottom. One end of this spring 32 abuts against a stopper 56 fixed to the rear housing 3 by means of a cap 59. The other end of the spring 32 abuts against the bottom surface of the spool valve 31. The inner space 33 of the spool valve 31 communicates with the crankcase 8 via a passage 34.

On one side (the upper side) of the spool valve 31, the urging force of the spring 32 and the pressure of the crankcase 8 act in a direction in which the urging force and pressure close the spool valve 31 (in a direction in which the urging force and pressure reduce the opening of the valve 31). On the other hand, when the spool valve 31 is open as shown in FIG. 1, the discharge port 1*a* and the discharge chamber 12 communicate with each other via the discharge passage 39 and, therefore, on the other side (the lower side) of the spool valve 31 the pressure of the discharge port 1*a* and the pressure of the discharge chamber 12 act in a direction in which both pressures open the spool valve 31 (in a direction in which both pressures increase the opening of the valve 31). However, when a pressure difference between the crankcase 8 and the discharge port 1*a* becomes not more than a prescribed value, the spool valves 31 moves in a closing direction and blocks the discharge passage 39. As a result, on the lower side of the spool valve 31, the pressure of the discharge port 1*a* ceases to act and only the pressure of the discharge chamber 12 acts in a direction in which the pressure opens the valve 31.

The discharge chamber 12 and the crankcase 8 communicate with each other via a second passage 57. Midway in this second passage 57, a control valve 100 of this embodiment, which will be described in detail later, is disposed at a position lower than the center position of the compressor 1. In the case of a large thermal load, this second passage 57 is blocked because a valve element 132 is placed on a valve seat due to the energization of the solenoid 131A of the control valve 100. On the other hand, in the case of a small thermal load, the second passage 57 communicates because the valve element 132 leaves a valve seat 125*a* due to the stop of the energization of the solenoid 131A. The operation of the control valve 100 is controlled by a computer (not shown).

The suction chamber 13 and the crankcase 8 communicate with each other via a first passage 58. This first passage 58 is composed of an orifice (a second orifice) 58*a* formed in the valve plate 2*a*, a passage 58*b* formed in the cylinder block 2, and a hole 58*c* formed in a ring (an annular part) 9 fixed to the shaft 5. The suction chamber 13 and the crankcase 8 communicate with each other via a third passage 60.

This third passage 60 is composed of a passage 60*a* formed in the front housing 4, a front-side bearing-housing space 60*b*, a passage 60*c* formed in the shaft 5, a rear-side bearing-housing space 60*d* formed in the cylinder block 2, the passage 58*b* of cylinder block 2, and an orifice 58*a* of valve plate 2*a*.

Therefore, the passage 58*b* of cylinder block 2 and the orifice 58*a* of valve plate 2*a* constitute part of the first passage 58 and, at the same time, constitute also part of the third passage 60.

A female thread 61 is formed on the inner peripheral surface of the rear-side end of the passage 60*c* formed in the shaft 5. A screw 62 is screwed into this female thread 61. An orifice (a first orifice) 62*a* is formed in this screw 62, and the passage area of this orifice 62*a* is smaller than the passage area of the second orifice 58*a* in the valve plate 2*a* that constitutes part of the first passage 58. Therefore, only in a case where the boss 10*b* of wobble plate 10 almost blocks the hole 58*c* of ring 9 and the passage area of the first passage 58 has decreased greatly, the coolant in the crankcase 8 is introduced into the suction chamber 13 via the third passage 60.

In the valve plate 2*a*, there are provided a plurality of discharge ports 16, which provide communication between a compression chamber 82 and the discharge chamber 12, and a plurality of suction ports 15, which provide communication between the compression chamber 82 and the suction chamber 13, respectively, at equal intervals in the circumferential direction. The discharge port 16 is opened and closed by a discharge valve 17. The discharge port 17, along with a valve-holding member 18, is fixed to the side end surface of the rear housing of valve plate 2*a* by means of a bolt 19 and a nut 20. On the other hand, the suction port 15 is opened and closed by a suction valve 21. This suction valve 21 is disposed between the valve plate 2*a* and the cylinder block 2.

The rear-side end of the shaft 5 is rotatably supported by a radial bearing (a rear-side bearing) 24 housed in the rear-side bearing-housing space 60*d* of cylinder block 2 and a thrust bearing (a rear-side bearing) 25. On the other hand, the front-side end of the shaft 5 is rotatably supported by a radial bearing (a front-side bearing) 26 housed in the front-side bearing-housing space 60*b* of front housing 4. A shaft seal 46, in addition to the radial bearing 26, is housed in the front-side bearing-housing space 60*b*.

A female thread 1*b* is formed in the middle of the cylinder block 2. An adjusting nut 83 engages on this female thread 1*b*. A preload is given to the shaft 5 via the thrust bearing by tightening this adjusting nut 83. Furthermore, a pulley (not shown) is fixed to the front-side end of the shaft 5.

A thrust flange 40 that transmits the rotation of the shaft 5 to the wobble plate 10 is fixed to the shaft 5. This thrust flange 40 is supported by the inner wall surface of the front housing via a thrust bearing 33*a*. The thrust flange 40 and the wobble plate 10 are connected to each other via a hinge mechanism 41. The wobble plate 10 is mounted on the shaft 5 so that the wobble plate 10 can slide on the shaft 5 and can, at the same time, incline with respect to a virtual surface at right angles to the shaft 5.

The hinge mechanism 41 is composed of a bracket 10*e* provided on a front surface 10*c* of wobble plate 10, a linear guide groove 10*f* provided in this bracket 10*e*, and a rod 43 screw-threaded onto a wobble plate-side side surface 40*a* of the thrust flange 40. The longitudinal axis of the guide groove 10*f* is inclined to the front surface 10*c* of wobble plate 10 at a prescribed angle. A spherical portion 43*a* of the rod 43 is slidably fitted into the guide groove 10*f*.

Figure 3:
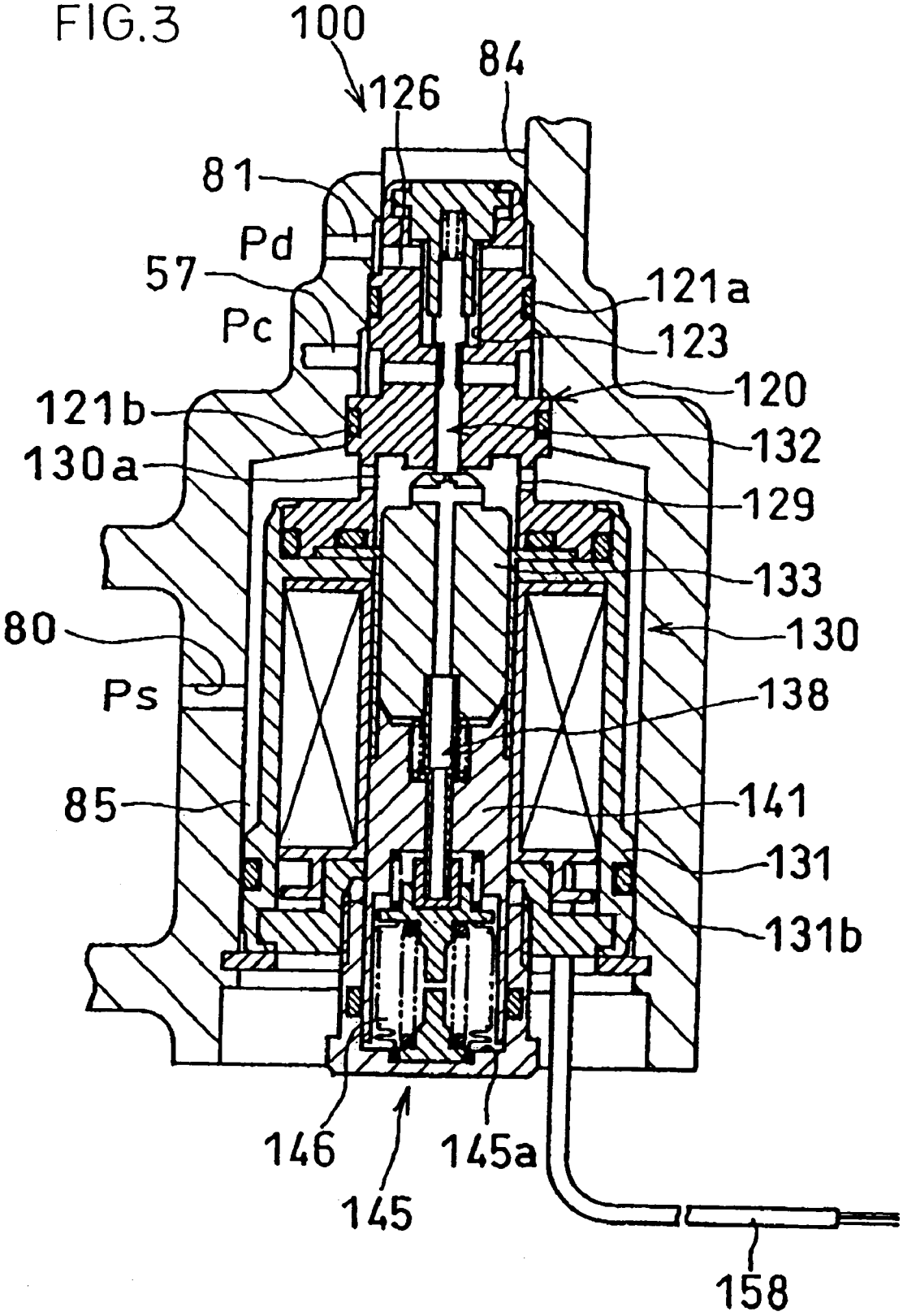
FIG. 3 is an enlarged longitudinal sectional view of a control valve for the variable capacity compressor shown in FIG. 1.

Next, the control valve 100 for variable capacity compressors in this embodiment will be explained in detail by referring to FIGS. 3 and 4. FIG. 3 is a longitudinal sectional view of a control valve 100 built in a variable capacity compressor 1 and FIG. 4 is a longitudinal sectional view of the details of the control valve shown in FIG. 3.

Figure 2:
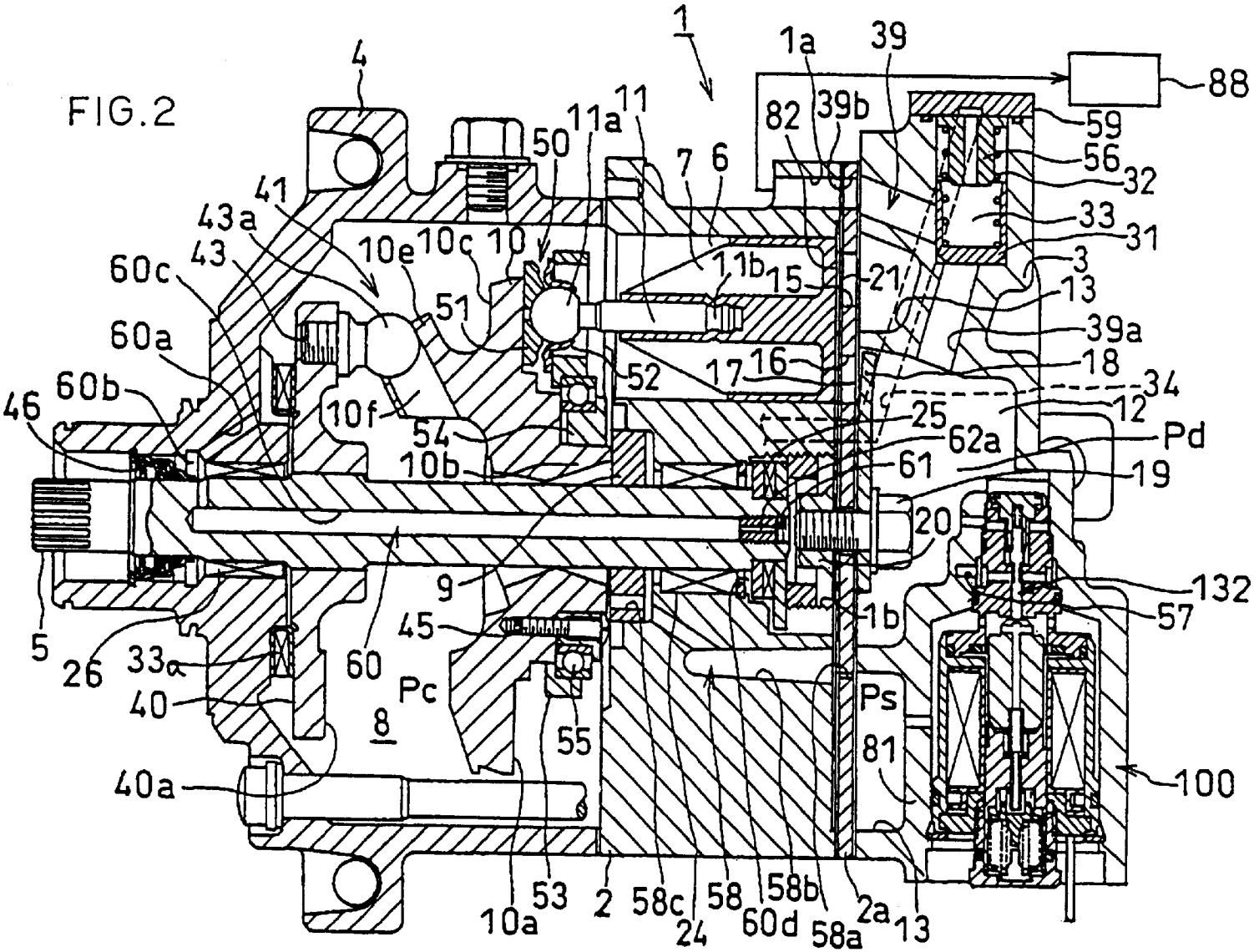
FIG. 2 is a longitudinal sectional view of the variable capacity compressor shown in FIG. 1, wherein the discharge passage is in closed state.

The control valve 100 is disposed in the spaces 84, 85 of the rear housing 3 of the variable capacity compressor 1 shown in FIGS. 1 and 2 with an airtight state maintained via O-rings 121*a*, 121*b*, 131*b*.

Figure 4:
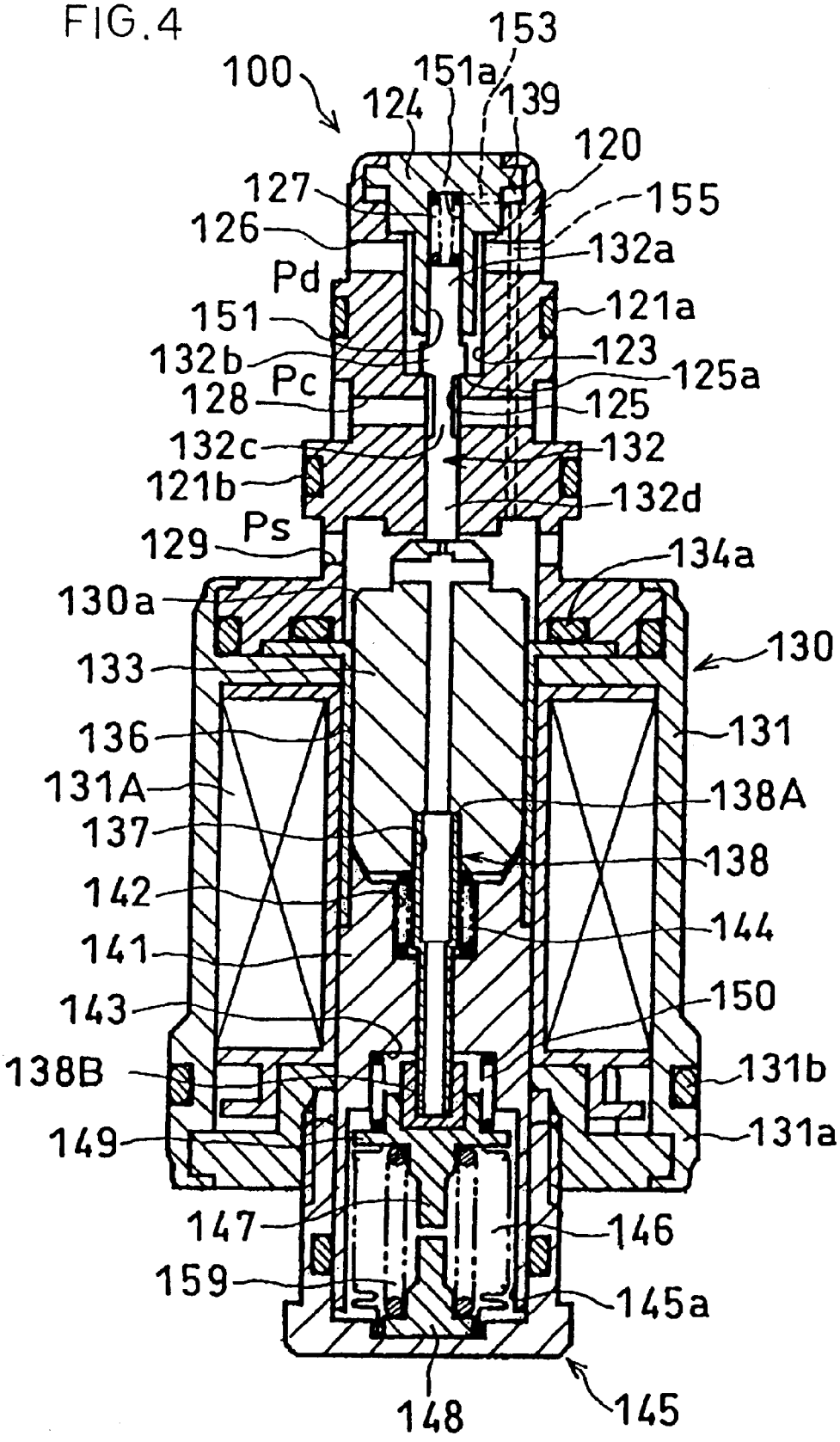
FIG. 4 is a longitudinal sectional view of the details of the control valve shown in FIG. 3.

As shown in FIG. 4, the control valve 100 is composed of a control valve body 120, a solenoid excitation part 130, and a pressure-sensitive part 145. The solenoid excitation part 130 is disposed in the middle, the control valve body 120 is disposed on the upper side of the solenoid excitation part 130, and the pressure-sensitive part 145 is disposed on the lower side of the solenoid excitation part 130.

The solenoid excitation part 130 is provided with a solenoid housing 131 along the periphery thereof. In the interior of this solenoid housing 131, a solenoid 131A, a plunger 133 that moves vertically by the excitation of the solenoid 131A, an attraction element 141, and a stem 138 are disposed. A plunger chamber 130*a* that houses the plunger 133 communicates with a suction coolant port 129 provided in the control valve body 120.

The pressure-sensitive part 145 is arranged on the lower side of the solenoid housing 131. In a pressure-sensitive chamber 145*a* formed in this pressure-sensitive part 145, a bellows 146 and a spring 159 that operate the plunger 133 via the stem 138, etc are disposed.

The control valve body 120 is provided with a valve chamber 123. In this valve chamber 123, a valve element 132 that performs opening and closing operations by the plunger 133 is disposed. A coolant gas at a high discharge pressure Pd flows into this valve chamber 123 via a passage 81 and a discharge coolant port 126. On the bottom surface of the valve chamber 123, a valve hole 125 that communicates with a crankcase coolant port 128 is formed. The space in the upper part of the valve chamber 123 is blocked by a stopper 124. In the center part of this stopper 124, a pressure chamber 151 opposite to the valve hole 125 is formed. This pressure chamber 151 is a bottomed pit having the same sectional area with the valve hole 125. This pressure chamber 151, which is a bottomed pit, functions also as a spring-housing chamber 151*a* and, on the bottom thereof, a valve-closing spring 127 for urging the valve element 132 toward the bottom of the valve chamber 123 is disposed.

The valve element 132 is composed of an upper portion 132*a*, an enlarged valve element portion 132*b*, a small-diameter portion 132*c*, and a lower portion 132*d*. The valve element 132 takes on the shape of a bar as a whole and the upper portion 132*a* and lower portion 132*d* thereof have a sectional area equal to that of the valve hole 125. The upper portion 132*a* is fitted onto and supported by the stopper 124 having the pressure chamber 151. The enlarged valve element portion 132*b* is arranged in the valve chamber 123. Within the valve hole 125, the small-diameter portion 132*c* is opposed to a crankcase coolant port 128 that communicates with the crankcase (crankcase pressure Pc). The lower portion 132*d* is fitted onto and supported by the interior of the control valve body 120, and the lower end thereof is inserted into the plunger chamber 130*a*, into which a coolant gas at the suction pressure Ps is introduced, and is in contact with the plunger 133. For this reason, when the plunger 133 moves up and down, the valve element 132 moves up and down, where by a gap between the enlarged valve element portion 132*b* of valve element 132 and a valve seat 125*a* formed in the upper surface of the valve hole 125 is adjusted.

And the suction pressure Ps at a low temperature that flows into the plunger chamber 130*a* is introduced into the pressure-sensitive part 145, which will be described later, and at the same time this suction pressure Ps is also introduced into a suction-pressure introduction space 85 between the rear housing 3 and a solenoid housing 131 (FIG. 3). This suction-pressure introduction space 85 is sealed by an O-ring 131*b* provided on a projection 131*a* formed on the side of the solenoid housing 131, whereby the cooling of the whole side of the solenoid housing 131 is accomplished by a low-temperature coolant gas from the suction chamber 13.

In the interior of the solenoid housing 131, which is caulked and connected to the control valve body 120, the plunger 133 that contact-fixes the valve element 132 as shown in FIG. 4 is disposed. This plunger 133 is slidably housed in a pipe 136 attached to an end of the control valve body 120 via an O-ring 134*a*.

A stem 138 is fixed to the plunger 133, with the upper portion 138A thereof being inserted in a housing hole 137 formed at the lower end of the plunger 133. On the other hand, the lower portion 138B of the stem 138, which passes through an upper-end-housing hole 142 of the attraction element 141 and protrudes from the side of a lower-end-housing hole 143, can slide with respect to the attraction element 141. Between the plunger 133 and the upper-end-housing hole 142 of the attraction element 141, there is provided a valve-opening spring 144 that urges in a direction in which the valve-opening spring 144 detaches the plunger 133 from the side of the attraction element 141.

Also, the stem 138 is arranged in such a manner that the lower portion 138B thereof can come into contact with or leave a first stopper 147 within the bellows 146 disposed in a pressure-sensitive chamber 145*a*. Within the bellows 146, a second stopper 148, in addition to this first stopper 147, is provided. Between a flange 149 of the first stopper 147 and the lower-end-housing hole 143 of the attraction element 141, there is provided a spring 150 that urges in a direction in which the spring 150 detaches the first stopper 147 from the side of the attraction element 141.

When the suction pressure Ps in the pressure-sensitive chamber 145*a* increases, the bellows 146 contracts and the first stopper 147 comes into contact with the second stopper 148. At this point of time, the contracting action (displacement) of the bellows 146 is controlled. The maximum amount of displacement of this bellows 146 is set so that it becomes smaller than the maximum amount of fit between the lower portion 138B of stem 138 and the first stopper 147 of bellows 146.

Incidentally, a cord 158 capable of feeding a solenoid current that is controlled by a control computer (not shown) is connected to the solenoid 131A (FIG. 3).

Also, the stopper 124 that blocks the valve chamber 123 is provided with a transverse hole 153 that communicates with the pressure chamber 151, as shown in FIG. 4. This transverse hole 153 provides communication between a gap 139 formed by the stopper 124 and control valve body 120 and the pressure chamber 151. On the other hand, a cancel hole 155 that provides communication between the gap 139 and the plunger chamber 130*a* into which a coolant gas at the suction pressure Ps flows is formed in the control valve body 120.

Figure 5A:
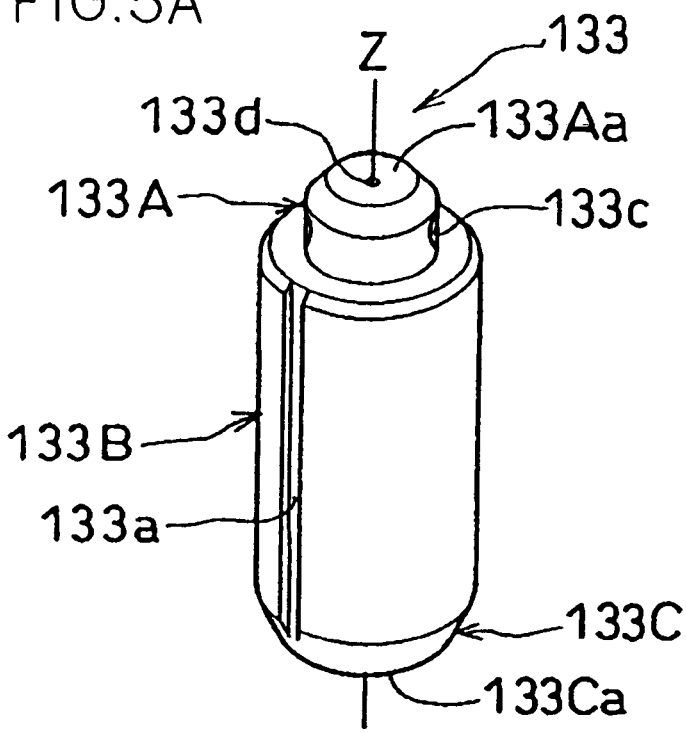
FIGS. 5A and 5B are a perspective view and a longitudinal sectional view, respectively, of a plunger of control valve shown in FIG. 3.

The structure of the plunger 133 will be described below by referring to FIG. 5A (a perspective view) and FIG. 5B (a longitudinal sectional view).

The plunger 133 comprises a head 133A and a barrel 133B. The head 133A faces the lower end of the control valve body 120. On the other hand, the barrel 133B slides within the pipe 136. Incidentally, the upper portion 138A of the stem 138 passes through the lower end 133C of the barrel 133B.

The head 133A of the plunger 133 has an almost cylindrical shape with a smaller diameter than the barrel 133B and is in contact with the lower end of the control valve body 120. Furthermore, as shown in FIG. 5A, this head 133A has an upper end surface 133Aa that is in contact with the lower portion 132*d* of the valve element 132. At the center of this upper end surface 133Aa, a first coolant vent 133*d* that extends in the longitudinal (z axis) direction of the plunger 133 is formed. Furthermore, on the side surface of the head 133A, as shown in FIG. 5B, there is provided a second coolant vent 133*c* that extends while intersecting the longitudinal (z axis) direction of the plunger 133. These first and second coolant vents 133*d*, 133*c* communicate with each other in the head 133A of the plunger 133. The first coolant vent 133*d* has a radius about half the radius of the second coolant vent 133*c*.

The barrel 133B of the plunger 133 has an almost cylindrical shape and, on the outer surface thereof, a slit 133*a* that extends parallel to the longitudinal (z axis) direction of the plunger 133 is formed. A coolant at the suction pressure Ps is introduced by this slit 133*a* into the pressure-sensitive part 145. On the other hand, in the interior of the barrel 133B of plunger 133, as shown in FIG. 5B, there is provided a third coolant vend 133*b* that extends in the longitudinal (z axis) direction of the plunger 133. This third coolant vent 133*b* and the second coolant vent 133*c* communicate with each other in the head 133A of the plunger 133. The third coolant vent 133*b* and second coolant vent 133*c* have the same inside diameter. Therefore, the diameter of the first coolant vent 133*d* is smaller than the diameter of the second and third coolant vents 133*c*, 133*b*.

The lower end 133C of the barrel 133B of plunger 133 has a shape tapering toward a lower end surface 133C*a* of the plunger 133, and, in the interior thereof, a housing hole 137 that receives the upper portion 138A of the stem 138 is formed. This housing hole 137 communicates with the third coolant vent 133*b*. Therefore, between the upper end surface 133Aa and lower end surface 133Ca of plunger 133, there is provided communication by the first coolant vent 133*d* and the third coolant vent 133*b*.

Figure 6A:
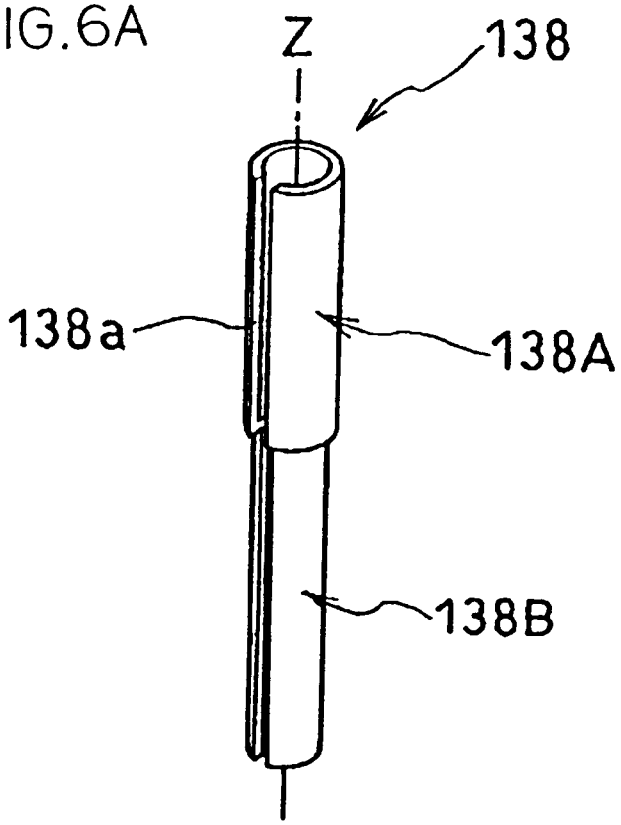
FIGS. 6A and 6B are a perspective view and a longitudinal sectional view, respectively, of a stem of control valve shown in FIG. 3.
Figure 6B:
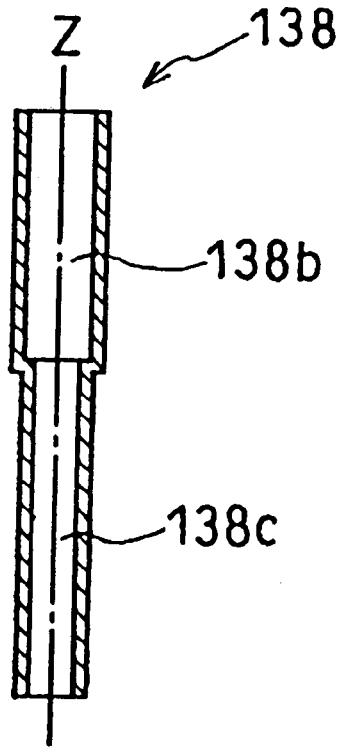

An example of structure of the stem 138 will be described below by referring to FIG. 6A (a perspective view) and FIG. 6B (a longitudinal sectional view).

The stem 138 is composed of an upper portion 138A, which is passed through the housing hole 137 of the plunger 133, and a lower portion 138B. The upper portion 138A has an almost cylindrical shape and a hollow part formed therein in the longitudinal (z axis) direction of the stem 138 functions as a coolant vent 138*b*. On the other hand, the lower portion 138B has an almost cylindrical shape with a smaller diameter than the upper portion 138A, and a hollow part formed therein in the longitudinal (z axis) direction of the stem 138 functions as a coolant vent 138*c*.

Also, on the outer surface of the stem 138(including the upper portion 138A and lower portion 138B), a slit 138*a* that extends parallel to the longitudinal (z axis) direction of the stem 138 is formed. Because the stem 138 is provided with this slit 138*a*, it is possible to prevent the sticking of the outer peripheral surface of the stem 138 to the inner peripheral surface of the housing hole 137 for receiving the plunger 133 and the sticking of the outer peripheral surface of the stem 138 to the inner peripheral surface of the attraction element 141.

Figure 7:
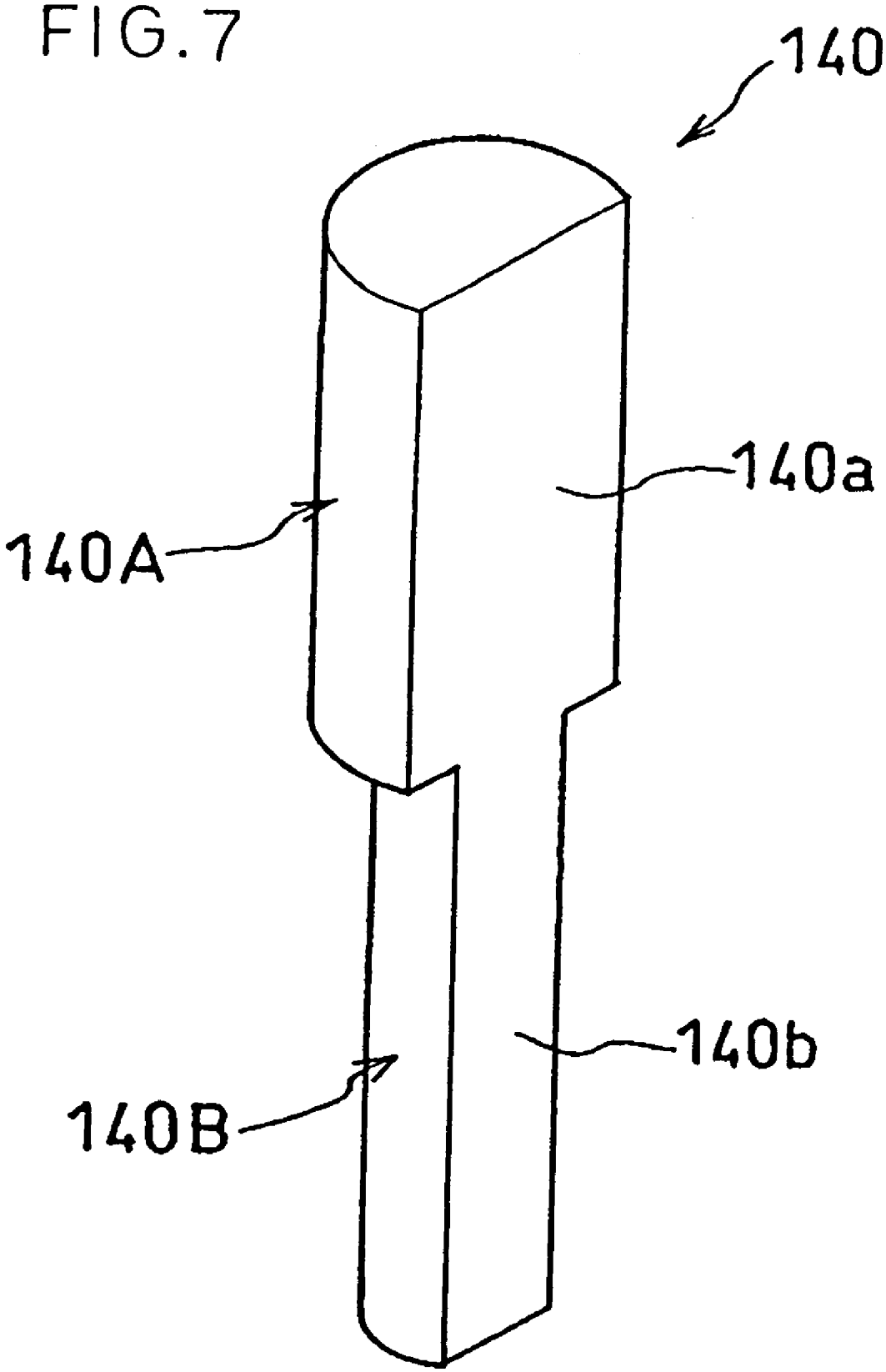
FIG. 7 is a perspective view of a stem whose structure is different from that of the stem shown in FIGS. 6A and 6B.

Next, another example of stem structure will be described below by referring to FIG. 7 (a perspective view).

A stem 140 is composed of a head 140A and a barrel 140B. On the side surfaces of the head 140A and barrel 140B, respectively, there are formed flat portions 140*a*, 140*b*. That is, the section of the head 140A and barrel 140B has an almost half-moon shape. Because the stem 140 (including the head 140A and the barrel 140B) is provided, on the outer surface thereof, with flat portions 140*a*, 140*b* as described above, a gap is generated each between the outer peripheral surface of the stem 140 and the inner peripheral surface of the housing hole 137 for receiving the plunger 133 and between the outer peripheral surface of the stem 140 and the inner peripheral surface of the attraction element 141, whereby it is possible to prevent the sticking of the outer peripheral surface of the stem 138 to the inner peripheral surface of the housing hole 137 for receiving the plunger 133 and the sticking of the outer peripheral surface of the stem 138 to the inner peripheral surface of the attraction element 141.

As described above, because the stem 138 is provided with the slit 138*a* (or because the stem 140 is provided with the flat portions 140*a*, 140*b*), it is possible to prevent the sticking of the stem 138 (or 140) to the plunger 133 and attraction element 141. Furthermore, in a case where the plunger 133 is located in a place lower than the center position of the compressor 1, even when a coolant gas having a low suction pressure Ps is introduced to the side of the bellows 146 below the plunger 133 and a coolant pool is formed on the lower side of the plunger 133, it is possible to prevent phenomena such as delays in the operation of the plunger and stem, because it becomes easy for the coolant that has collected to move.

Next, the operation of the variable capacity compressor 1 in which the control valve 100 of this embodiment is built will be described below.

The rotary power of a car-mounted engine is transmitted to the shaft 5 from a pulley (not shown) via a belt (not shown). The rotary power of the shaft 5 is transmitted to the wobble plate 10 via the thrust flange 40 and hinge mechanism 41 thereby to rotate the wobble plate 10.

By the rotation of the wobble plate 10, the shoe 50 performs relative rotation on the sliding surface 10*a* of the wobble plate 10. As a result, the piston 7 performs linear reciprocating motions and changes the volume of the compression chamber 82 in the cylinder bore 6. According to this volume change of the compression chamber 82 the suction, compression and discharge processes of a coolant gas are sequentially performed and the coolant gas of a volume corresponding to the inclination angle of the wobble plate 10 is delivered.

First, in the case of a large thermal load, the flow of the coolant gas from the discharge chamber 12 to the crankcase 8 is blocked and, therefore, the pressure of crankcase 8 drops and a force generated on the rear surface of the piston 7 during the compression process decreases. For this reason, the sum total of forces generated on the rear surface of the piston 7 drops below the sum total of forces generated on the front surface (top surface) of the piston 7. As a result, the inclination angle of the wobble plate 10 increases.

When the pressure of discharge chamber 12 rises and the pressure difference between the discharge chamber 12 and the crankcase 8 becomes not less than a specified value, with the result that the pressure of the coolant gas in the discharge chamber 12 acting on the lower side of the spool valve 31 exceeds the sum total of the pressure of the coolant gas in the crankcase 8 acting on the upper side of the spool valve 31 and the urging force of the spring 32, then the spool valve 31 moves in an opening direction and the discharge passage 39 opens (FIG. 1), as a result of which the coolant gas in the discharge chamber 12 flows out of the discharge port 1*a* into a capacitor 88.

Incidentally, when the inclination angle of the wobble plate 10 changes from a minimum to a maximum, the boss 10*b* of the wobble plate 10 leaves the hole 58*c* of the ring 9 and the first passage 58 is fully opened, with the result that the coolant gas in the crankcase 8 flows into the suction chamber via the first passage 58. For this reason, the pressure of the crankcase 8 drops. Furthermore, when the passage area of the first passage 58 becomes a maximum, the coolant gas scarcely flows from the third passage 60 into the suction chamber 13.

When in this manner the thermal load increases and the solenoid 131A of the control valve 100 is excited, the plunger 133 is attracted toward the attraction element 141 and the valve element 132 with which the plunger 133 is in contact moves in a direction in which the valve element 132 closes the valve opening, whereby the flow of the coolant gas into the crankcase 8 is blocked.

On the other hand, the low-temperature coolant gas is introduced into the pressure-sensitive part 145 from the side of the passage 80 that communicates with the suction chamber 13 via the suction coolant port 129 of the control valve body 120 and the plunger chamber 130*a*. As a result, the bellows 146 of the pressure-sensitive part 145 displaces on the basis of the coolant gas pressure that is the suction pressure Ps of the suction chamber 13. The displacement of this bellows 146 is transmitted to the valve element 132 via the stem 138 and plunger 133. That is, the opening of the valve hole 125 by the valve element 132 is determined by the attractive force of the solenoid 131A, the urging force of the bellows 146 and the urging force of the valve-closing spring 127 and of the valve-opening spring 144.

And when the pressure in the pressure-sensitive chamber 145*a* (the suction pressure Ps) increases, the bellows 146 contracts and the movement of the valve element 132 responds to this displacement of the bellows 146 (the direction of displacement of the valve element 132 corresponds to the direction of attraction of the plunger 133 by the solenoid 131A), whereby the opening of the valve hole 125 is reduced. As a result, the volume of the high-pressure coolant gas introduced from the discharge chamber 12 into the valve chamber 123 decreases (the crankcase pressure Pc drops) and the inclination angle of the wobble plate 10 increases (FIG. 1).

Also, when the pressure in the pressure-sensitive chamber 145*a* drops, the bellows 146 is expanded by the restoring force of the spring 159 and the bellows 146 itself and the valve element 132 moves in a direction in which the valve element 132 increases the opening of the valve hole 125. As a result, the volume of the high-pressure coolant gas introduced into the valve chamber 123 increases (the crankcase pressure Pc increases) and the inclination angle of the wobble plate 10 in the state shown in FIG. 1 decreases.

In contrast to this, when the thermal load is small, the high-pressure coolant gas flows from the discharge chamber 12 into the crankcase 8, thereby raising the pressure of the crankcase 8. As a result, a force generated on the rear surface of the piston 7 during the compression process increases and the sum total of forces generated on the rear surface of the piston 7 exceeds the sum total of forces generated on the front surface of the piston 7, thereby reducing the inclination angle of the wobble plate 10.

When the pressure difference between the discharge chamber 12 and the crankcase 8 becomes not more than a specified value and the sum total of the pressure of the crankcase 8 acting on the upper side of the spool valve 31 and the urging force of the spring 32 exceeds the pressure of the coolant gas in the discharge chamber 12 acting on the lower side of the spool valve 31, then the spool valve 31 moves in a closing direction and blocks the discharge passage 39 (FIG. 2), thereby blocking the outflow of the coolant gas from the discharge port 1*a* into the capacitor 88.

Incidentally, when the inclination angle of the wobble plate 10 becomes a minimum from a maximum, the boss 10*b* of the wobble plate 10 almost blocks the hole 58*c* of the ring 9 and substantially reduces the passage sectional area of the first passage 58. However, because the coolant gas in the crankcase 8 flows out toward the suction chamber 13 via the third passage 60, an excessive pressure increase in the crankcase 8 is suppressed and it becomes possible for the coolant gas in the compressor 1 to circulate. That is, the coolant gas flows through the suction chamber 13, compression chamber 82, discharge chamber 12, second passage 57, crankcase 8 and third passage 60, and returns to the suction chamber 13 again.

In this embodiment, the structure is such that the pressure of crankcase 8 is caused to act on one side of the spool valve 31 that functions as the discharge control valve, while the pressure of discharge chamber 12 is caused to act on the other side, and the spring 32 having a relatively small spring force is used to urge the spool valve 31 in a direction in which the spring 32 closes the spool valve 31. Therefore, when the thermal load decreases and the pressure of discharge chamber 12 drops gradually, the stroke of the piston 7 becomes a minimum (an extra-small load) and the spool valve 31 maintains an open state until the wobble plate 10 reduces the passage area of the first passage 58.

When in this manner the thermal load decreases and the solenoid 131A is demagnetized, the attractive force to the plunger 133 disappears, with the result that the plunger 133 moves in a direction in which the plunger 133 leaves the attraction element 141 due to the urging force of the valve-opening spring 144 and the valve element 132 moves in a direction in which the valve element 132 opens the valve hole 125 of the control valve body 120, whereby the inflow of the coolant gas into the crankcase 8 is promoted.

When the pressure in the pressure-sensitive part 145 rises, the bellows 146 contracts and the opening of the valve element 132 decreases. However, because the lower portion 138B of the stem 138 can come close to and away from the first stopper 147 of the bellows 146, the displacement of the bellows 146 will not have an effect on the valve element 132.

As described above, the control valve of this embodiment 100 is constituted by the solenoid excitation part 130, which is provided, at the middle thereof, with the plunger 133 moving vertically by the excitation of the solenoid 131A, the pressure-sensitive part 145, in which the bellows 146 operating synchronously with the plunger 133 via the stem 138, etc. is disposed on the lower side of the solenoid excitation part 130, and the control valve body 120 that has the valve chamber 123 in which the valve element 132 operating synchronously with the plunger 133, etc., are disposed on the upper side of the solenoid housing 131. Therefore, because the pressure-sensitive chamber 145*a* and the solenoid 131A are disposed in close vicinity to each other, the point of application by the attraction of the solenoid 131A and the point of application by the bellows 146 approach each other, with the result that when the valve element 132 and stem 138 move simultaneously in a closing direction, the occurrence of backlash between them is minimized as far as possible.

Now, TABLE 1 shows measured values obtained in an experiment on the load of sticking between the upper end surface 133Aa of the head 133A of the plunger 133 and the lower end of the control valve body 120.

TABLE 1

| No. | | Tensile load | Dead weight | Sticking load |
|---|---|---|---|---|
| 1 | 9.5 | 205 | 13.9 | 191.1 |
| 2 | 6.0 | 40 | 12.8 | 27.2 |
| 3 | 4.0 | 14 | 12.6 | 1.4 |
| 4 | 9.5 | 145 | 13.6 | 131.4 |
| 5 | 4.0 | 11.7 | 11.7 | 0.0 |

In TABLE 1, No. 1 to No. 3 denote a plunger provided with no coolant vent. Nos. 4 and 5 denote a plunger provided with the first coolant vent 133*d* (refer to FIG. 5B) and the second coolant vent 133*c* or the third coolant vent 133*b* that communicates with the first coolant vent 133*d*.

In this experiment, plungers 133 with different diameters of upper end surface 133Aa of head 133A were used. After attaching the upper end surface 133Aa of plunger 133 to an oil-applied flat plate at an atmosphere temperature of 20° C., an actual force (tensile force) necessary for detaching the plunger 133 was measured and by subtracting the dead weight of the plunger 133 from this tensile load, the sticking load of the plunger 133 (unit: gram) was found. The result is shown in TABLE 1. This sticking load is equivalent to the resistance value during the detaching of the plunger 133 from the flat plate.

From TABLE 1, it is apparent that the sticking load can be reduced to about 1/130 by reducing the diameter $\phi$ of the upper end surface 133Aa of the plunger to about ½ (refer to Nos. 1 and 3).

In particular, in the case of the plunger No. 5, the sticking load becomes almost zero and it is apparent that the plunger 133 of this structure ensures positive valve-closing operation, etc. because during the closing of the valve element 132, the coolant does not collect any more between the upper end surface 133Aa of the plunger and the lower portion 132*d* of the valve element 132.

From the above-described results, it is apparent that by reducing the diameter of the head 133A of plunger 133 in comparison with the diameter of the barrel 133B, the contact area between the upper end surface 133Aa of the head 133A of plunger 133 and the lower end of the control valve body 120 (refer to FIG. 4) is reduced, whereby the sticking of the plunger 133 to the control valve body 120 is suppressed, making it possible to operate the valve element 132 smoothly.

Figure 5B:
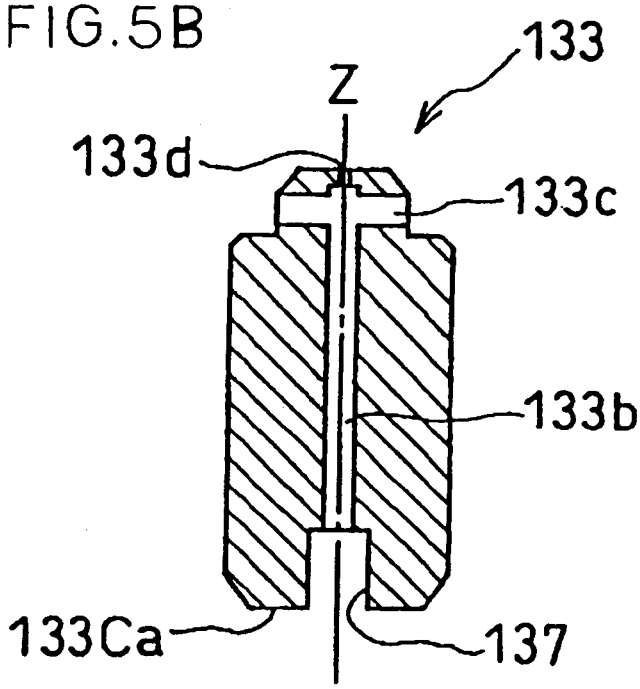

Also, by installing, as shown in FIG. 5B, the third coolant vent 133*b* and first coolant vent 133*d* that extend in the longitudinal direction of the plunger 133, the coolant gas is prevented from collecting between the upper end surface 133Aa of the plunger and the lower portion 132*d* of the valve element 132 even during the closing of the valve element 132. In addition, by installing the second coolant vent 133*c* that radially extends in the plunger 133, the movement of the coolant gas in the plunger chamber 130*a* is made smooth.

Therefore, by forming, in the plunger 133, the first and third coolant vents 133*d* and 133*b* that extend in the longitudinal direction thereof and the second coolant vent 133*c* that extends in the radial direction intersecting these two coolant vents and, at the same time, by making the diameter of the third coolant vent 133*b* and the diameter of the second coolant vent 133*c* equal to each other thereby to provide communication therebetween, whereby it is ensured that even during the closing of the valve element 132, the cooling gas does not collect between the upper end surface 133Aa of the plunger and the lower portion 132*d* of the valve element 132 and, at the same time, the coolant gas that has collected below the plunger 133 can be easily moved to the upper portion of the plunger chamber 130*a*. For this reason, delays in the operation of the plunger 133 and the like do not occur any Now, TABLE 2 shows measured values obtained in an experiment on the damper effect of oil and the viscous sliding resistance between the inner peripheral surface of the pipe 136 and the outer peripheral surface of the plunger 133.

TABLE 2

| No. | | Dead weight | Sliding resistance |
|---|---|---|---|
| | Tensile load | | |
| 1 | 506 | 14.0 | 492.0 |
| 2 | 250 | 13.8 | 236.2 |
| 3 | 20 | 11.7 | 8.3 |
| | Compressive load | | |
| 1 | 107 | 14.0 | 121.0 |
| 2 | 104 | 13.8 | 117.8 |
| 3 | 0 | 11.7 | 11.7 |

In TABLE 2, No. 1 denotes a plunger 133 in which one slit 133*a* extending parallel to the longitudinal direction of the plunger is formed on the side surface of the barrel 133B thereof, No. 2 denotes a plunger 133 in which two above-described slits 133*a* are formed on the side surface of the barrel 133B thereof, and No. 3 denotes a plunger 133 which is provided with the first, second and third coolant vents 133*d*, 133*c* and 133*b* and in which one slit 133*a* is formed on the side surface of the barrel 133B thereof.

In this experiment, after inserting the plunger 133 into a pipe containing oil at an atmosphere temperature of 20° C., a tensile load or compressive load necessary for vertically moving the plunger 133 was measured and by subtracting the dead weight of the plunger from the measured value or adding the dead weight of the plunger to the measured value, a force necessary for moving the plunger 133 (sliding resistance, unit: gram) was found. The result is shown in TABLE 2.

The tensile load (a force necessary for pulling up the plunger 133 in a direction in which the valve element 132 opens) of the of No. 2 plunger 133 is reduced to about ½ of the tensile load of the No. 1 plunger. It can be understood that this is because the No. 2 plunger 133 has more slits than the No. 1 plunger 133.

The tensile load of the No. 3 plunger 133 is reduced to about 1/60 of that of the No.1 plunger 133, and the compressive load (a force necessary for pushing down the plunger 133 in a direction in which the valve element 132 closes) of the No. 3 plunger is reduced to about 1/10 of that of the No. 1 plunger 133.

Therefore, by forming the slit 133*a* on the side surface of the barrel 133B of plunger 133, it is possible to destroy the full-circumference pressure balance between the inner peripheral surface of the pipe 136 and the outer peripheral surface of the plunger 133, whereby the sticking of the plunger 133 can be prevented and the valve element can be smoothly moved.

Furthermore, by forming the coolant vents 133*b*, 133*c*, 133*d* in the interior of the plunger 133, it is possible to easily move the coolant gas that has collected to the upper portion of the plunger chamber 130*a*, whereby delays in the operation of the plunger 133 and the like can be prevented.

Also, by forming, in the interior of the stem 138, the coolant vents 138*b*, 138*c* that extend in the longitudinal direction thereof, it becomes easy to move the cooling gas that has collected below the stem 138 to the upper portion of the plunger chamber 130*a* via the second and third coolant vents 133*c*, 133*d* of the plunger 133, whereby delays in the operation of the stem 138 and the like can be prevented.

Furthermore, by forming the slit 138*a* on the side surface of the stem 138 (FIG. 5A) or by making the section of the stem 140 half-mooned and not circular (FIG. 7) thereby to prevent the sticking of the outer peripheral surface of the stem 138, 140 to the inner peripheral surfaces of the plunger 133 and attraction element 141, whereby the motion of the plunger 133 and valve element 132 can be made smooth.

Figure 8:
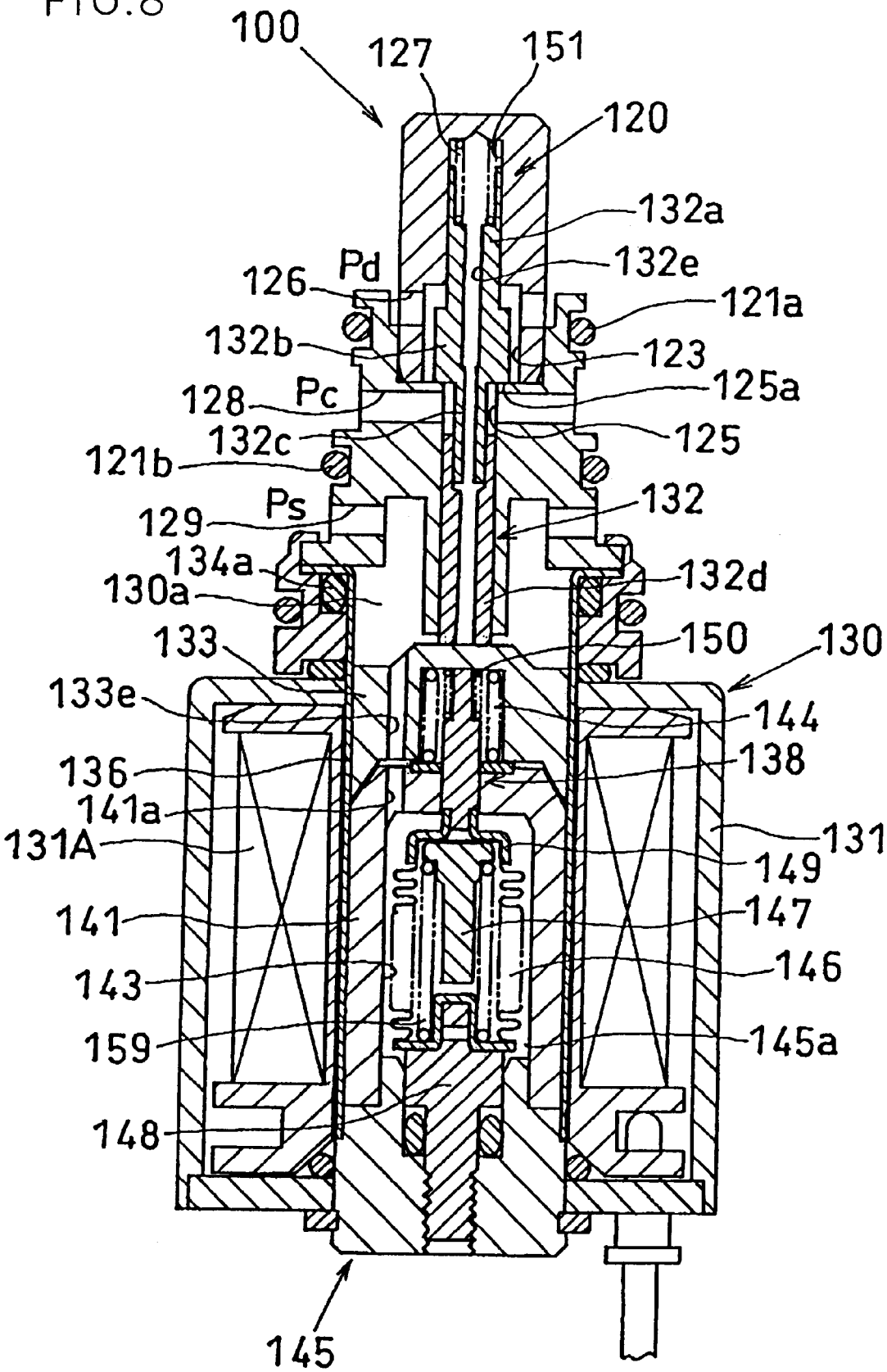
FIG. 8 is an enlarged longitudinal sectional view of a control valve in the second embodiment of the present invention.

Next, a control valve 100 in the second embodiment of the present invention will be described below by referring to FIG. 8.

Because the control valve 100 for variable capacity compressors of this embodiment has features mainly in the structure of a cancel hole and a pressure-sensitive part, these points will be described below in detail.

A valve element 132 of the control valve 100 is composed of an upper portion 132*a*, an enlarged valve element portion 132*b*, a small-diameter portion 132*c*, and a lower portion 132*d*. The upper portion 132*a* is housed in a pressure chamber 151. The enlarged valve element portion 132*b* is arranged in a valve chamber 123. The small-diameter portion 132*c* is present in a valve hole 125 and is opposed to a crankcase coolant port 128. The lower portion 132*d* is fitted into the interior of a control valve body 120 and the lower end thereof is inserted into a plunger chamber 130*a*, into which a cooling gas at the suction pressure Ps is introduced, and is in contact with a plunger 133.

Furthermore, the valve element 132 is, at the center thereof, provided with a cancel hole 132*e* in the longitudinal axial direction. The pressure chamber 151 and the plunger chamber 130*a* communicate with each other via this cancel hole 132*e*.

In the control valve 100 of the above-described first embodiment, as shown in FIG. 4, the communication between the pressure chamber 151 and the plunger chamber 130*a* is provided by the transverse hole 153 formed in the stopper 124 and the cancel hole 155 formed in the control valve body 120. In contrast to this, in the control valve 100 of the second embodiment, by forming the cancel hole 132*e* in the valve element 132 itself in such a manner that the cancel hole 132*e* passes through the valve element 132 from the upper portion 132*a* thereof to the lower portion 132*d*, communication is provided between the pressure chamber 151 and the plunger chamber 130*a*.

Accordingly, the coolant gas at the suction pressure Ps in the plunger chamber 130*a* is introduced into the pressure chamber 151 via the cancel hole 132*e*. Then, the valve element 132 receives the suction pressure Ps from both sides of each of the upper portion 132*a* and lower portion 132*d* thereof. In addition, because the upper portion 132*a* and lower portion 132*d* of the valve element 132 have the same sectional area, the suction pressure Ps received from both sides of the upper portion 132*a* and lower portion 132*d* thereof is balanced and canceled out each other, with the result that the valve element 132 is not virtually affected by the discharge pressure Pd.

Also, in this valve element 132, its portion near the crankcase coolant port 128 having the crankcase pressure Pc is formed as the small-diameter portion 132*c* and, therefore, when the enlarged valve element portion 132*b* of the valve element 132 is seated on a valve seat 125*a*, an unnecessary force will not act on the valve element 132 even when the valve element 132 is subjected to the pressure Pc in the crankcase because the upward and downward forces acting on the valve element 132 are balanced.

As described above, in the control valve 100 of this embodiment, pressure balance is always maintained above and under the valve element 132 and, therefore, it is possible to improve the valve opening and closing accuracy and besides working is easy compared with a case where the cancel hole is formed in the control valve body 120, making it possible to further reduce the manufacturing cost. Incidentally, this cancel hole may be formed in the valve element 132 of the control valve 100 of the first embodiment.

Also, an attraction element 141 of the control valve 100 of this embodiment, unlike that of the first embodiment, is in the form of a cylinder the bottom of which faces the plunger 133, and a bellows 146 is disposed in a pressure-sensitive chamber 145*a* formed in the interior of the cylinder. For this reason, a pressure-sensitive part 145 is formed in the inside of the attraction element 141 and hence scarcely protrude to the outside of a solenoid excitation part 130. In addition, compact design of the control valve 100 can be ensured by reducing the diameter of the solenoid excitation part 130. Incidentally, the bellows 146 is adjusted by the position adjustment of the stopper 148 from the outside.

Furthermore, because the plunger 133 and attraction element 141 of the control valve 100 of this embodiment are provided, in the longitudinal axial direction thereof, with coolant-introduction and coolant-vent holes 133*e* and 141*a*, the coolant gas at the suction pressure Ps in the plunger chamber 130*a* is introduced into the pressure-sensitive chamber 145*a*.

Figure 9:
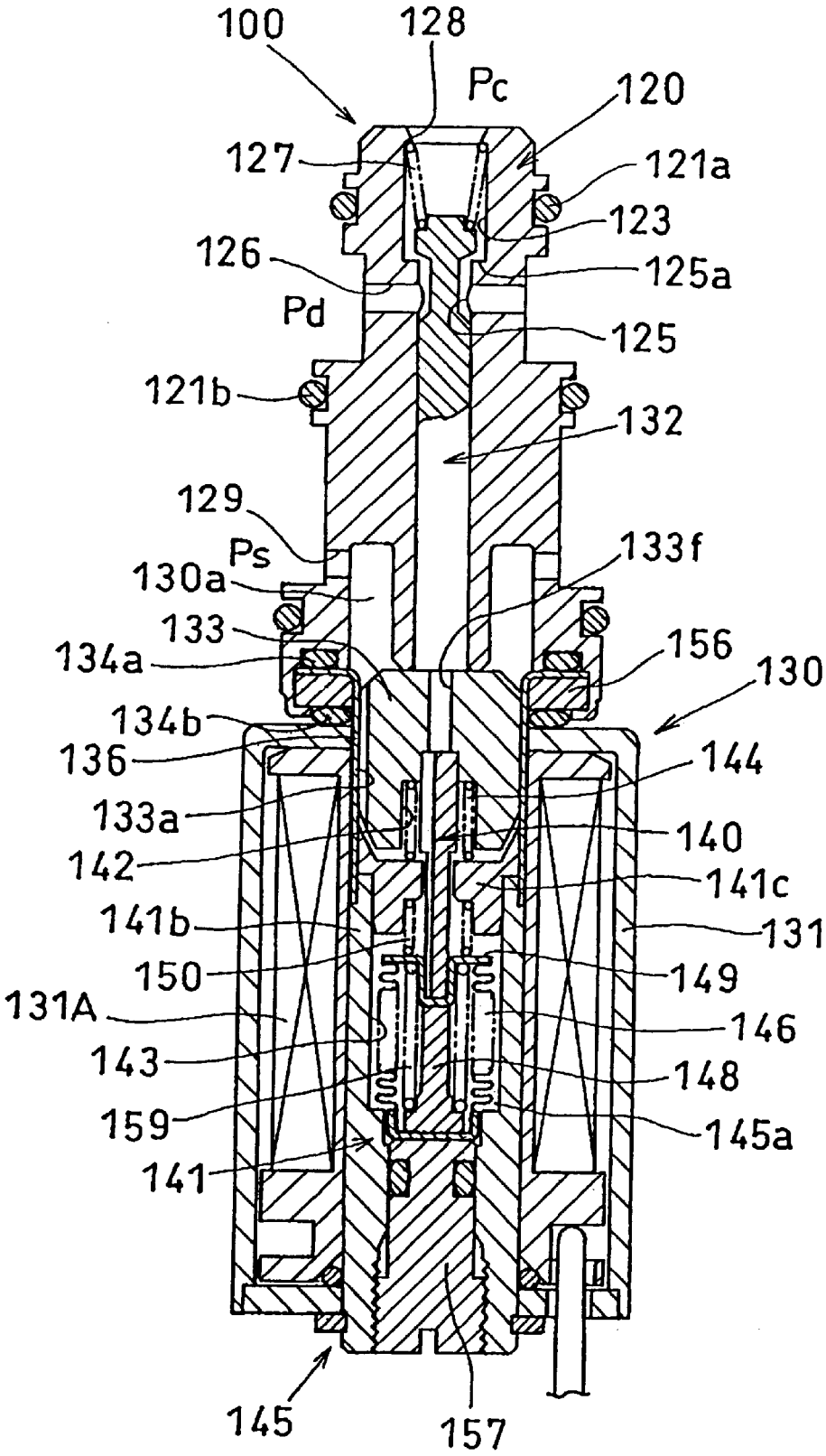
FIG. 9 is an enlarged longitudinal sectional view of a control valve in the third embodiment of the present invention.
Figure 10:
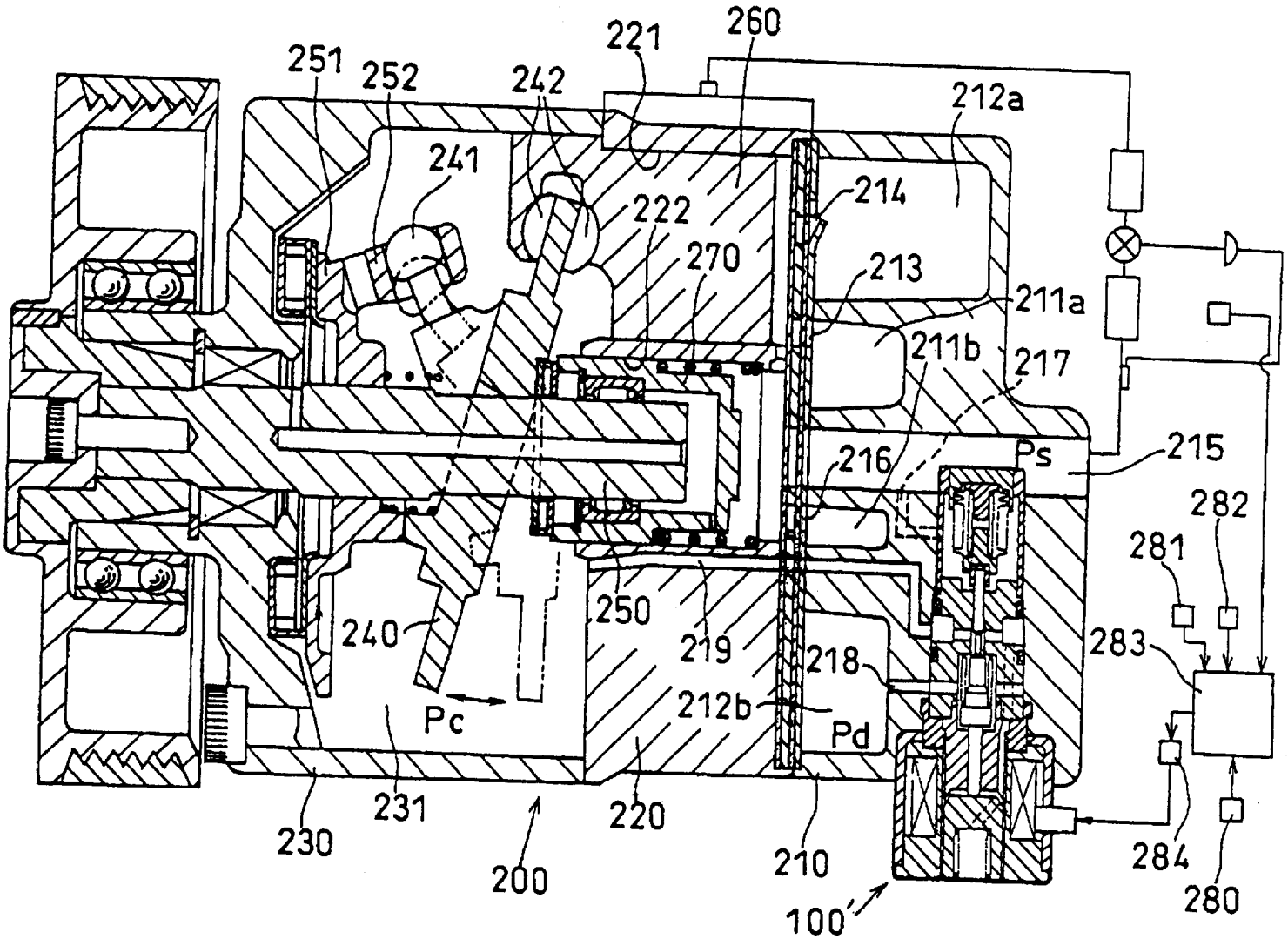
FIG. 10 is a longitudinal sectional view of a variable capacity compressor provided with a conventional control valve.
Figure 11:
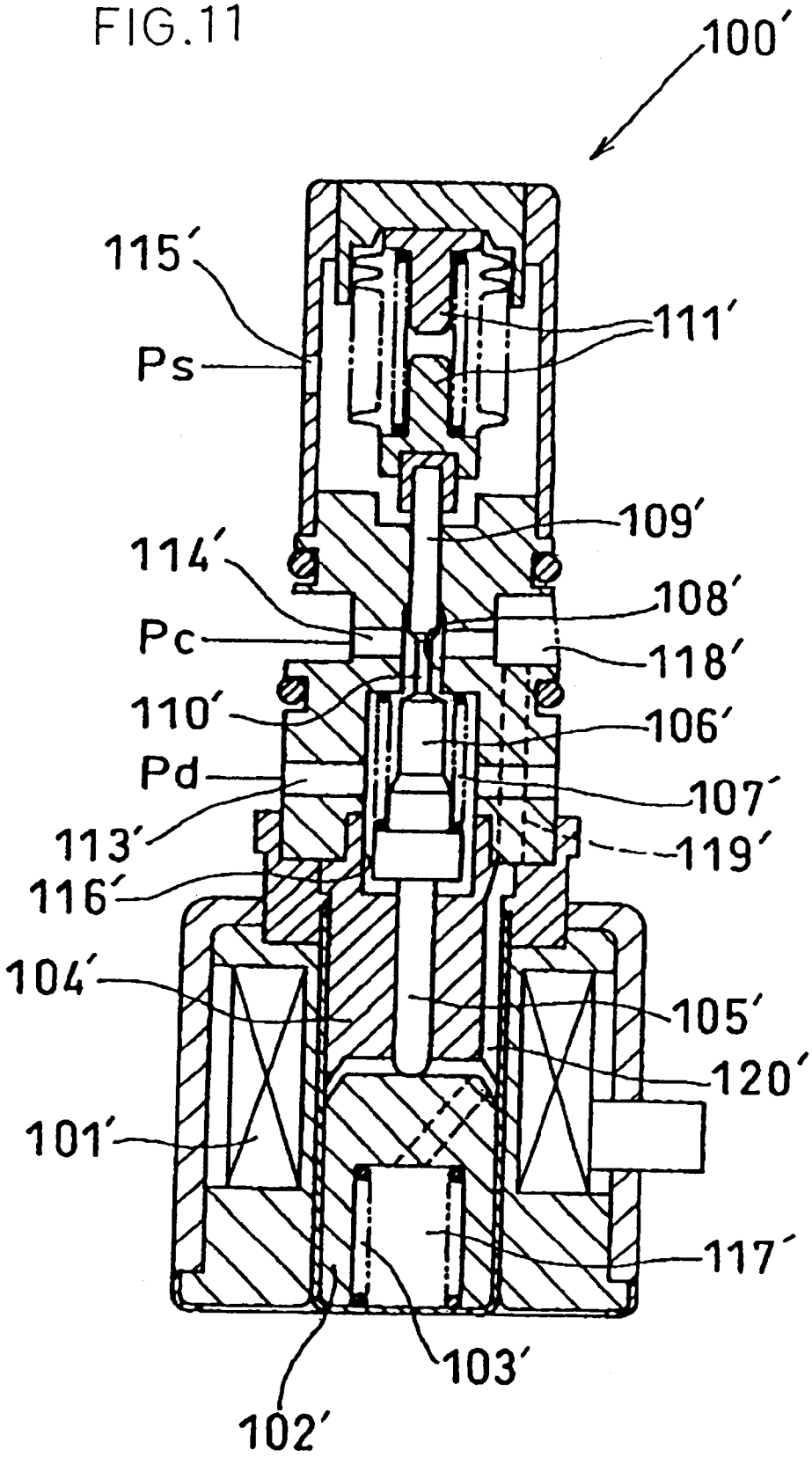
FIG. 11 is a longitudinal sectional view of the details of the control valve shown in FIG. 10.

Next, a control valve 100 in the third embodiment of the present invention will be described below by referring to FIG. 9.

The control valve 100 of this embodiment has features mainly in the structure of an attraction element and a pressure-sensitive part. An attraction element 141 of the control valve 100 is constituted by a cylindrical portion 141*b* engaged on the inside of a solenoid excitation part 130, a cover portion 141*c* press-fitted at the upper end of the cylindrical portion 141*b*, and an adjusting screw 157 engaged on the lower side of the cylindrical portion 141*b*. A pressure-sensitive part 145 is provided in the inside of the cylindrical portion 141*b*.

The cylindrical portion 141*b* of the attraction element 141 is, from the lower side thereof, engaged to the adjusting screw 157 and, on the other hand, from the upper side thereof, a stopper 148, a spring 159, a bellows 146 and a flange 149 of the stopper 148, and a spring 150 are installed. At the upper end of the cylindrical portion 141*b*, a cover portion 141*c* is press-fitted. And a joint between the cylindrical portion 141*b* and the cover portion 141*c* is TIG welded and a pressure-sensitive chamber 145*a* is formed inside the attraction element 141. For this reason, compact design can be ensured by the shortening in the longitudinal axial direction of the control valve 100. Incidentally, the adjusting screw 157 is intended for use in the adjustment of the displacement of the bellows 146 by the adjustment of the position of the stopper 148 from the outside.

A plunger 133 is provided with a coolant vent 133*f* in the interior thereof in the longitudinal direction and is also provided with a slit 133*a* for introducing the coolant at the suction pressure Ps into the pressure-sensitive part 145 in the outer surface thereof in the longitudinal direction. Furthermore, a stem 140 having an almost half-moon section as shown in FIG. 7 is used. Therefore, the coolant gas at the suction pressure Ps in the plunger chamber 130*a* is introduced into the pressure-sensitive part 145 via the slit 133*a* of plunger 133 and the stem 140.

Furthermore, a control valve body 120 and the solenoid excitation part 130 are, unlike those of the control valve 100 of the second embodiment, connected together via a pipe 136 and a spacer, by performing caulking from the side of the control valve body 120. Incidentally, a gap between the control valve body 120 and the solenoid excitation part 130 is sealed by means of packing 134*b*.

In the control valve for variable capacity compressors according to the present invention, as described above with respect to each of the embodiments, the opening and closing accuracy of the valve hole can be improved by eliminating an adverse effect of the operation of the valve element based on a coolant gas. Also, clutch-less operation of a compressor can be maintained by the improvement of the opening and closing accuracy of the valve hole.

Furthermore, the compact design of the control valve can be ensured by arranging the pressure-sensitive part within the attraction element.

What is claimed is:

1. A control valve for variable capacity compressors, comprising:

a solenoid excitation part having a solenoid and a plunger moving vertically by the excitation of said solenoid; and a control valve body disposed on the upper side of said solenoid excitation part and having a valve chamber provided with a valve hole on the bottom surface thereof, a pressure chamber disposed above said valve chamber, and a valve element disposed within said valve chamber and performing opening and closing operations by said plunger;

wherein, the upper end of the valve element of said control valve body is inserted in said pressure chamber, while the lower end of said valve element is inserted in a plunger chamber of said solenoid excitation part, said plunger chamber and said pressure chamber communicate with each other through a cancel hole formed in said valve element.

2. A control valve for variable capacity compressors, comprising:

a solenoid excitation part having a solenoid and a plunger moving vertically by the excitation of said solenoid;

a control valve body;

an attraction element provided on the lower side of the plunger of said solenoid excitation part; and a pressure-sensitive element formed on the inner side of said attraction element.

3. The control valve for variable capacity compressors according to claim 2, wherein said attraction element is in the form of a cylinder with a bottom opposed to said plunger.

4. The control valve for variable capacity compressors according to claim 2, wherein said attraction element comprises a cylindrical portion to be engaged with the inner side of said solenoid excitation part and a cover portion to be press-fitted to the upper end of said cylindrical portion.

5. The control valve for variable capacity compressors according to claim 1 or 2, wherein said plunger is provided with a coolant vent extending in the longitudinal axial direction.

6. The control valve for variable capacity compressors according to claim 2, wherein said plunger is provided with a slit, on the side surface thereof, extending in the longitudinal axial direction.

7. The control valve for variable capacity compressors according to claim 2, wherein said solenoid excitation part is provided with a stem having a substantially half-moon section for transmitting the motion of said pressure-sensitive part to said plunger.

* * * * *